United States Patent [19]

Summers

[11] 4,111,331

[45] Sep. 5, 1978

[54] TAMPER-PROOF CLOSURE DEVICE

[75] Inventor: Kenneth L. Summers, Angola, Ind.

[73] Assignee: Riehe Corporation, Auburn, Ind.

[21] Appl. No.: 821,802

[22] Filed: Aug. 4, 1977

[51] Int. Cl.[2] ..... B65D 45/32

[52] U.S. Cl. ..... 220/319; 220/288; 215/274

[58] Field of Search ..... 220/288, 306, 319, 320, 220/321, 266, 85 SP; 215/274, 278, 280, 324, 327

[56] References Cited

U.S. PATENT DOCUMENTS

| | | | |
|---|---|---|---|
| 2,080,983 | 5/1937 | Merolhe | 215/274 |
| 2,661,128 | 12/1953 | Rieke | 220/266 X |

*Primary Examiner*—George T. Hall

*Attorney, Agent, or Firm*—Woodard, Weikart, Emhardt & Naughton

[57] ABSTRACT

A tamper-proof container closure device having a closed cap member and a crimping ring. The closed cap member is internally threaded and has a flared annular skirt extending around its base. The crimping ring is snapped into a retained position on the flared annular skirt before the cap is screwed onto a container. After the cap is screwed onto a container, the crimping ring is deformable radially inward around a suitable boss at the container opening onto which the container closure device is installed, thereby drawing the flared annular skirt into sealing engagement with the periphery of the boss and preventing removal of the cap without first visibly tearing off the ring.

22 Claims, 10 Drawing Figures

TAMPER-PROOF CLOSURE DEVICE

BACKGROUND OF THE INVENTION

1. Field of the Invention

This invention relates in general to container screw-on closure devices and in particular to such closure devices which are designed to be tamper-proof.

2. Description of the Prior Art

There are various container caps and seals which attempt to provide for the enclosing and sealed retention of the particular contents within the container. Of course, the specific container design will control to a significant degree the type of cap or seal which can be used. One type of cap which is widely used is the solid, screw-on design such as found in supermarkets on glass, plastic and metal containers. Some of these caps, such as those on beverage bottles, are intended to be resealable and have a metal ring secured to the bottle and connected to the cap portion by means of a perforated seam. When the cap is turned in a counterclockwise direction in an attempt to unscrew the cap from the bottle, the perforations tear and the cap is removable. Cap designs of this type with retaining means prevent the cap from loosening due to vibrations which may occur during shipment.

Larger containers such as those used in the transport and storage of chemicals and industrial solutions, represent a different style of construction. Such containers have pour spout openings or the like which may be from two to four inches in diameter or larger and this size is not suitable for the metal perforated design previously described because of the torque required in order to tear the perforated seam and for other reasons. Often such containers are sealed with conventional screw-on caps which are retained in their screwed-on position by means of wire tagging which secures the cap to some anchor point on the container. This particular process is somewhat time consuming to perform and requires that suitable anchor points be added to the container. When the container is designed for transport or storage of a particular solution, the container material may be important so that the container will not contaminate its contents nor be adversely affected by the contents. Blow-molded plastic containers are widely used, but due to the flexibility of the material and thus of the spout opening, securely sealing this opening presents certain problems in the design and construction of retained and sealed closure devices.

SUMMARY OF THE INVENTION

A tamper-proof closure device according to one embodiment of the present invention comprises a closed cap member and a crimping ring. The closed cap member is internally threaded and has a flared annular skirt portion around its base. The crimping ring is snapped into a retained position around the cap member and overlaps the flared annular skirt portion. The crimping ring is deformable to press the flared annular skirt portion into secured sealing engagement with a raised outlet in a suitable container such that the container is sealed closed.

One object of the present invention is to provide an improved tamper-proof closure device.

Related objects and advantages of the present invention will be apparent from the following description.

DESCRIPTION OF THE PREFERRED EMBODIMENT

Figure 1:
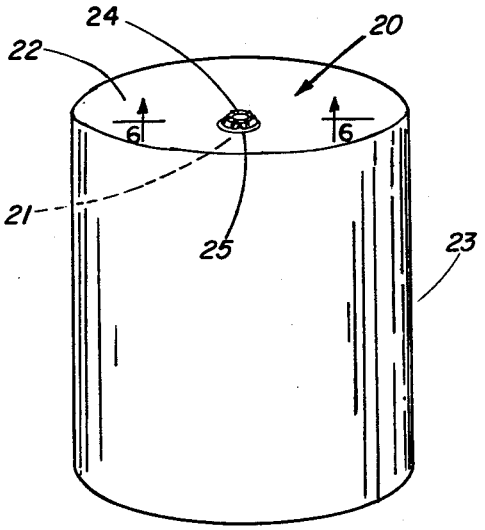
FIG. 1 is a perspective view of a container and a screw-on closure device according to a typical embodiment of the present invention.
Figure 2:
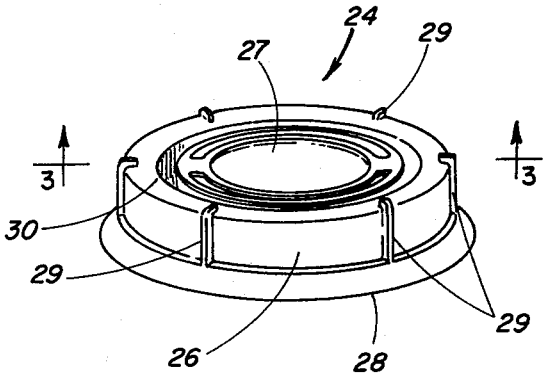
FIG. 2 is a perspective view of a closed cap member comprising a portion of the FIG. 1 closure device.
Figure 4:
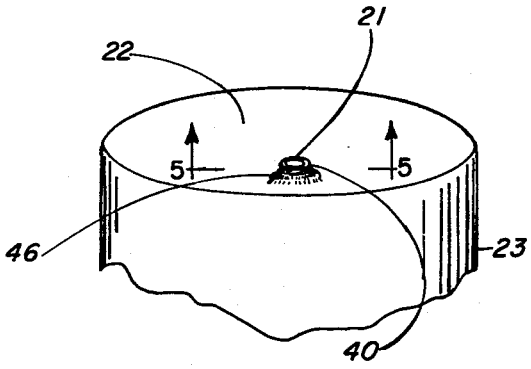
FIG. 4 is a perspective view of an outlet of the FIG. 1 container.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, screw-on closure device 20 is shown installed around a raised, externally threaded outlet 21 in the end 22 of container 23. Screw-on closure device 20 includes an internally threaded, closed cap member 24 and a crimping ring 25 snapped into a retained position on cap member 24.

Sealed cap member 24 which maybe molded in a single intricate member includes an outer wall 26, internal portion 27, flared annular skirt portion 28, stiffening ribs 29 and top surface 30. The flared annular skirt portion 28 extends beyond the outer wall 26 and serves both as a ring mount and as a sealing lip as will be described hereinafter. Outer wall 26 is slightly inclined inwardly from skirt portion 28 toward top surface 30.

The internal portion 27 of cap member 24 is designed very similar to the flexible pouring spouts disclosed in U.S. Pat. No. 2,661,128 and U.S. Pat. No. 2,895,654 which are hereby incorporated by reference. The flexible pouring spout which is foldable and nestable internal to cap member 24 comprises essentially two tubular portions 31 and 32 integral with each other. Portion 31 is frusto-conical in character and its smaller cross-sectional area is greater than the largest cross-sectional area of portion 32. Portion 32 which when unfolded and extended comprises the neck portion of the pouring spout is united to portion 31 by inwardly flared portion 33. The larger diameter base 36 of portion 31 is arranged with respect to top surface 30 and internal threads 37 to form an annular trough 38 which retains a sealing gasket 39.

In order to secure sealing cap member 24 onto container outlet 21, internal threads 37 mate with external threads 40 (see FIGS. 5 and 6) and as cap member 24 tightens into position the upper edge 41 of outlet 21 pushes against gasket 39 thereby providing a superior seal to that provided solely by the mating of the two flights of threads. The upper periphery of portion 32 as oriented in the extended position is externally threaded and receives internally threaded lid 44. Initially, the mouth of portion 32 is sealed closed by an integral diaphragm 45 which is adapted to be cut about its periphery by a cutting implement when the spout is first conditioned for pouring. Thereafter the pouring spout is closed by means of lid 44.

Figure 5:
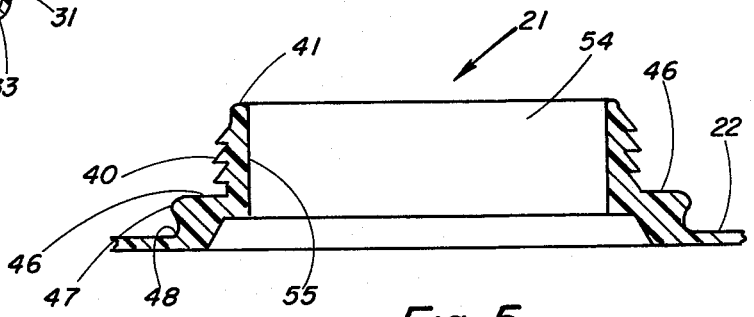
FIG. 5 is a sectional view of the FIG. 4 outlet taken along line 5—5 in FIG. 4.
Figure 6:
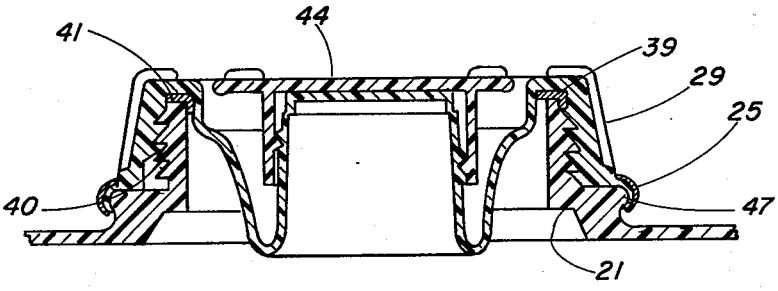
FIG. 6 is a sectional view of the FIG. 1 device, as installed in a container, taken along line 6—6 in FIG. 1.
Figure 7:
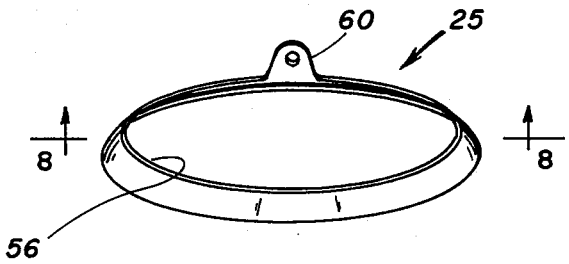
FIG. 7 is a perspective view of a crimping ring comprising a portion of the FIG. 1 closure device.
Figure 8:
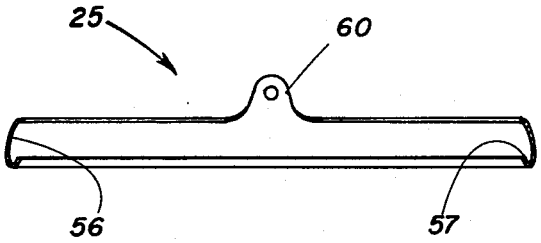
FIG. 8 is a sectional view of the FIG. 7 crimping ring taken along line 8—8 in FIG. 7.

Outlet 21, which is typically positioned toward one side of end 22, is raised above the surface of end 22 of container 23 and, according to a feature of the invention, an annular male boss 46 is formed therearound between the externally threaded portion (threads 40) and container end 22. As shown in FIG. 5, boss 46 has an outer corner 47 and a recessed surface 48 therebeneath.

Central passageway 54 disposed within upright wall 55 of the container opening provides an open cavity into which internal portion 27 of the cap member is positioned once cap member 24 is secured onto outlet 21. In the folded position (see FIG. 6), internal portion 27 is nested within the outer wall 26 of cap member 24 and within the upright wall 55 of outlet 21 where internal portion 27 is shielded from contact with foreign objects. In this manner, internal portion 27 (which converts into a pouring spout when extended and cut open) will not be subject to being cut or torn inadvertently and the sealing of the contents of container 23 will be preserved until diaphragm 45 is purposely opened.

Although the attachment of cap member 24 to outlet 21 as described provides an adequate seal for the contents of container 23 during static conditions such as storage, it is known that when transporting liquid containers, vehicle vibrations transmitted to the containers sometimes loosen the mating threads, causing caps to back off from tightened positions. If cap member 24 (without ring 25) would thereby become sufficiently loosened, the contents within container 23 may no longer be sealed in by gasket 39 to the extent necessary to prevent contamination and to avoid possible spilling.

In order to tightly secure cap member 24 onto outlet 21 so that the two will not loosen or separate due to tampering or otherwise until the user is ready, crimping ring 25 is provided. Ring 25 is fabricated from a single piece of aluminum, such as for example, 5050H19 and is formed with an inner arcuate contour 56 which conforms closely to the curvature of flared annular skirt portion 28 which it overlaps. Annular skirt portion 28 has an inner arcuate contoured surface which surrounds boss 46 and extends over the upper portion of boss 46, thereby providing means for an additional seal against leakage. The inside diameter of ring 25 is large enough to permit the ring to slide over the stiffening ribs 29. However, when the annular skirt portion 28 is reached by ring 25, additional force is required to push ring 25 down over skirt portion 28 and to actually snap the ring around the skirt portion. A slight lip 57 is formed on the underside of ring 25 and this lip creates a type of channel within the inner arcuate contour 56 into which skirt portion 28 fits. Lip 57 also provides a retaining edge which keeps ring 25 from moving in an upward direction which would tend to separate ring 25 from skirt portion 28. Thus, once ring 25 is snapped onto skirt portion 28, ring 25 will be securely held in place.

When cap member 24 is fully tightened onto outlet 21, the flared annular skirt portion 28 on which ring 25 is retained, is adjacent outer corner 47 of outlet 21. The lower edge of ring 25 which is adjacent lip 57 is crimped radially inward, pushing skirt portion 28 into sealing contact with recessed surface 48 (see FIGS. 5 and 6). This crimping operation actually bends ring 25 over the outer corner 47 of the boss and into recessed surface 48, and as this occurs skirt portion 28 makes a type of wrap-around seal with the outlet boss 47 entirely around its circumference. By being permanently deformed and by necking down beneath outer corner 47, ring 25 rigidly secures cap member 24 onto outlet 21 in a tamper-proof arrangement.

Ring 25 includes a tear tab 60 which is used to tear off ring 25 from around cap member 24 and outlet 21. For example, when access to container contents is needed, other than simply by use of the pouring spout, ring 25 can be removed by pulling down on tab 60. This action tears a segment of aluminum out of ring 25 disrupting its otherwise continuous nature and thus allows the ring to be peeled off of annular skirt portion 28.

Figure 3:
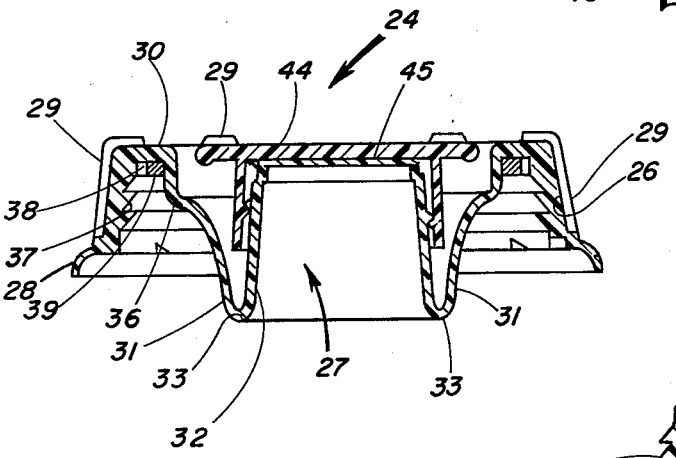
FIG. 3 is a sectional view of the FIG. 2 cap member taken along line 3—3 in FIG. 2.

Removal of ring 25 will relieve the stress which is placed on skirt portion 28, and the skirt portion will return to its original shape as shown in FIG. 3.

Figure 9:
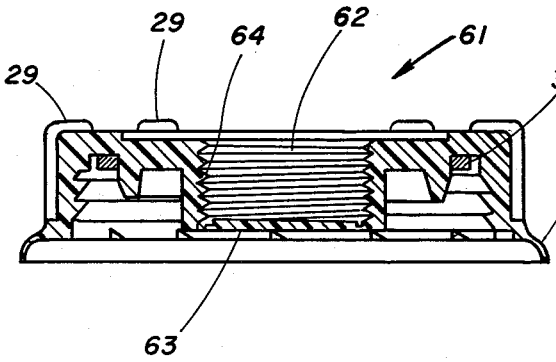
FIG. 9 is a sectional view of an alternate sealed cap member associated with the FIG. 1 screw-on closure device.
Figure 10:
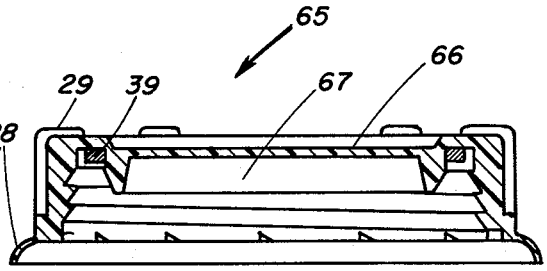
FIG. 10 is a sectional view of another alternate sealed cap member associated with the FIG. 1 screw-on closure device.

Although the invention has been described as applicable with cap member 24 which is of a foldable pouring spout arrangement, the use of ring 25 as a crimpable locking means is available for virtually any type of cap so long as the cap is compatibly sized and threaded to fit on the container outlet 21 and so long as the cap member 24 has a flared skirt portion similar in size and shape to skirt portion 28. Two such alternate cap designs are shown in FIGS. 9 and 10. The FIG. 9 cap member 61 is virtually identical to cap member 24 insofar as the present invention is concerned. It includes stiffening ribs 29, flared skirt portion 28 for receipt of ring 25, and sealing gasket 39 as previously described for sealed cap member 24. Although only a sectional view is shown, it is to be understood that cap member 61 is generally circular similar to cap member 24. Cap member 61 further includes a diaphragm 63 at the bottom of the flight of threads 64 and which serves as a seal for the contents of the container until the diaphragm is cut or punctured. This type of cap member is designed for mating to an external component such as, for example, a pipe or faucet member. The end of this external component cooperates in a mating arrangement with internal threads 64. In its absence, a plug can be installed in the threaded opening at 62.

The FIG. 10 cap member 65 is also virtually identical to cap members 24 and 61 except that the center portion is a single diaphragm covered passageway. Once diaphragm 66 is cut or punctured, passageway 67 serves as the outlet for the contents of the container. The cap member includes the features of the two previous cap members such as stiffening ribs 29, skirt portion 28 and sealing gasket 39. This type of cap member design is suitable for uses such as, for example, when the contents are to be pumped from the container.

In all of these various cap member designs, a suitable plastic material for molding the various shapes and features is a low density polyethylene, such as, for example, Union Carbide "DYNH-1." Although container 23 could be fabricated of metal and the outlet shaped by a drawing operation and then machining the threads, a typical construction is to blow-mold the container out of a high molecular weight, high density polyethylene. A typical container size is a 5 gallon capacity, and is suitable for whatever polyethylene will hold without being affected. These types of containers are well known in the industry and further details as to the mechanical features are not thought necessary.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A tamper-proof closure device for use with containers which comprises:

an internally threaded and closed cap member having a flared annular skirt portion around its base;

a crimping ring shaped into a retained position around said cap member and overlapping said flared annular skirt portion; and said crimping ring being deformable to press said flared annular skirt portion into secured sealing engagement with a raised outlet in a suitable container such that said container is sealed closed.

2. The closure device of claim 1 in which said crimping ring includes a tear tab for severing said ring from said cap member.

3. The closure device of claim 2 in which said crimping ring includes an inner arcuate contoured surface and a retaining lip therebeneath.

4. The closure device of claim 3 in which said cap member is of a single piece molded plastic construction of low density polyethylene.

5. The closure device of claim 4 in which said crimping ring is of a single piece aluminum construction.

6. The closure device of claim 5 in which said cap member has an internal sealing gasket positioned therein.

7. The closure device of claim 6 in which said cap member is sealed closed by means of a rupturable diaphragm.

8. The closure device of claim 7 in which said cap member includes an inner portion arranged as a flexible pouring spout, said spout being covered by said diaphragm.

9. The closure device of claim 7 in which said cap member includes an inner portion arranged as an internally threaded opening disposed above said diaphragm.

10. The closure device of claim 7 in which said cap member includes an inner portion arranged as a generally cylindrical passageway, said passageway being covered by said diaphragm.

11. In combination:

a container having an externally threaded, raised outlet and a male annular boss extending radially outwardly from beneath said threads and an annular recessed portion beneath said boss;

an internally threaded closed cap member having a flared annular skirt portion around its base, said annular skirt portion having an inner arcuate contoured surface, said surface being disposed around and partially over said boss;

a crimping ring snapped into a retained position around said cap member and overlapping said flared annular skirt portion; and said crimping ring being deformed around said boss and into said recessed portion such that said skirt portion is clamped against said boss and said raised outlet is sealed closed.

12. The combination of claim 11 in which said crimping ring includes a tear tab for severing said ring from said cap member.

13. The combination of claim 12 in which said crimping ring includes an inner arcuate contoured surface and a retaining lip therebeneath.

14. The combination of claim 13 in which said cap member is of a single piece molded plastic construction of low density polyethylene.

15. The combination of claim 14 in which said crimping ring is of a single piece aluminum construction.

16. The combination of claim 15 in which said cap member has an internal sealing gasket positioned therein.

17. The combination of claim 16 in which said container is of a molded plastic construction of high molecular weight, high density polyethylene.

18. The combination of claim 17 in which said cap member is sealed closed by means of a rupturable diaphragm.

19. The combination of claim 18 in which said cap member includes an inner portion arranged as a flexible pouring spout, said spout being covered by said diaphragm.

20. The closure device of claim 19 in which said annular skirt portion is resiliently deformed by said ring when said ring is deformed around said boss.

21. The closure device of claim 20 in which said lip cooperates with said annular skirt portion such that said ring is removable from said cap member only by destruction of said ring.

22. A method of providing a tamper-proof enclosure to a container which comprises:

snapping a metal ring into a retained position on a cap member having a gasket disposed therein;

mating said cap member with an outlet of said container by means of internal and external threads;

tightening said cap member until said cap member and said outlet are rigidly secured to each other and said gasket is engaged by said outlet to form a first seal between said cap member and said outlet; and crimping said ring inwardly into an annular recess of said outlet to secure said cap member tightly around said outlet thereby providing a second seal between said cap member and said outlet.

* * * * *